US005256167A

United States Patent [19]

Kaneko et al.

[11] Patent Number: 5,256,167

[45] Date of Patent: Oct. 26, 1993

[54] GASOLINE

[75] Inventors: Takashi Kaneko; Koji Oyama; Tatsuo Omata, all of Yokohama, Japan

[73] Assignee: Nippon Oil Co., Ltd., Tokyo, Japan

[21] Appl. No.: 885,463

[22] Filed: May 19, 1992

[30] Foreign Application Priority Data

May 21, 1991 [JP] Japan ..... 3-144082

[51] Int. Cl.[5] ..... C10L 1/18

[52] U.S. Cl. ..... 44/449; 44/459

[58] Field of Search ..... 44/449, 459

[56] References Cited

U.S. PATENT DOCUMENTS 2,952,612 9/1960 Trainer ..... 44/449
3,224,848 12/1965 Henderson ..... 44/449
4,519,809 5/1985 Hochhauser ..... 44/449

FOREIGN PATENT DOCUMENTS 636585 2/1962 Canada ..... 44/449
939796 10/1963 United Kingdom ..... 44/449

*Primary Examiner*—Ellen M. McAvoy
*Attorney, Agent, or Firm*—Bucknam and Archer

[57] ABSTRACT

A specified gasoline capable of maintaining a high octane number and reducing the amount of NOx to be contained in exhaust gases when consumed, which comprises as essential components (A) 3–30 vol. % of methyl-t.-butyl ether and (B) 1–15 vol. % of light straight-run naphtha with the balance being a base gasoline, the amounts of the components (A) and (B) being each based on the amount of the specified gasoline.

5 Claims, No Drawings

GASOLINE

BACKGROUND OF THE INVENTION

1. Field of the Invention

This invention relates to an especially useful gasoline as a fuel for automobiles and more particularly to a novel gasoline having a specified composition and exhibiting various excellent performances when used.

2. Prior Art

Methyl-t.-butyl ether (MTBE) has heretofore been known as a base for a gasoline having a high octane number. In addition, it has been noted in the United States to add MTBE to a fuel in order to decrease the amounts of carbon monoxide and hydrocarbons in exhaust gases produced from the fuel.

The MTBE-added gasoline is disclosed in, for example, Japanese Patent Gazettes Nos. Sho 50-35524, Sho 60-11958 and 60-233198 (or Nos. 35524/75, 11958/85 and 233198/85) as well as Japanese Pat. Appln. Laid-Open Gazettes No. Sho 58-11592 and No. Hei 3-93894 (or Nos. 11592/83 and 93894/91).

It is known that in a case where a MTBE-added gasoline is used in each of engines, the amount of nitrogen oxides (NOx) contained in exhaust gases discharged from each of many of said engines will increase.

SUMMARY OF THE INVENTION

The inventors had made intensive studies in an attempt to inhibit the amount of NOx evolved from a MTBE-added gasoline and contained in exhaust gases produced by said gasoline, and, as a result of their studies, they found that the addition of a light straight-run naphtha (LSR) having specified properties to gasoline enables the LSR-added gasoline to inhibit the evolution of NOx to be contained in exhaust gases while it maintains its octane number at a high level. This invention is based on this finding.

This primary object of this invention is to provide a specified gasoline which when used will produce exhaust gases containing NOx in a lower amount while it has a high octane number.

The object is achieved by the provision of a specified gasoline which comprises as the essential components (A) 3-30% by volume of MTBE and (B) 1-15% by volume of light straight-run naphtha (LSR), each based on the total amount of the specified gasoline.

This invention will be explained below in more detail.

Methyl-t.-butyl ether (MTBE) which is (A) component according to this invention may generally be obtained by reacting isobutylene with methanol; however, methods for preparing MTBE are not particularly limited.

The component (A), MTBE, is contained in an amount by volume of 3-30%, preferably 5-15%, more preferably 5-10%, based on the total amount of a specified gasoline of this invention. The MTBE content of less than 3 vol. % will exhibit none of effects which are otherwise to be obtained by the addition of MTBE, whereas the MTBE content of more than 30 vol. % will degrade fuel consumption, have inconvenient effects on drivability and remarkably increase the content of NOx in exhaust gases.

The component (B), light naptha (LSR), is defined to be such that its 10% distillation temperature is 30°-40° C. and its 90% distillation temperature is 50°-65° C. This LSR (component B) may usually be obtained by fractionating a naphtha fraction produced by atmospheric distillation of a crude oil.

The content of the LSR in the specified gasoline is 1-15 vol. %, preferably 2-7 vol. %, based on the total amount of the gasoline.

The LSR content of less than one vol. % in a gasoline will exhibit no NOx-inhibiting effects, whereas the LSR content of 15 vol. % in a gasoline will decrease the gasoline in octane number.

The gasoline of this invention may have optional amounts of the components (A) and (B), and however, a volume ratio ($V_B/V_A$) of the component (B) to the component (A) is $0.34 \leqq V_B/V_A \leqq 1.00$. In this case, the components (A) and (B) indicate contents (Vol. %) of the components (A) and (B) in the gasoline, respectively. The present invention enables the gasoline to inhibit the evolution of NOx to be contained in exhaust gases without decreasing its octane number by regulating the amounts of the components (A) and (B) within the above predetermined range.

The gasoline of this invention may suitably be incorporated with such materials as used in an ordinary gasoline, in addition to the components (A) and (B). Such materials include cracked gasoline obtained by a catalytic cracking, hydrocracking or like method; reformed gasoline obtained by a catalytic reforming or like method; polymerized gasoline obtained by the polymerization of olefins; alkylates obtained by addition reacting (alkylating) a hydrocarbon such as isobutane with a lower olefin; isomerate; dewaxed n-paraffin oil; a fraction of the above oils which has a specified boiling range; and aromatic hydrocarbons.

The gasoline of this invention may be obtained by mixing together, for example, 10-40 vol. % of reformed gasoline; 0-30 vol. % of a light fraction obtained from cracked gasoline, the light fraction boiling in the range of from the initial boiling point of the cracked gasoline to 80° C.; 10-40 vol. % of a heavy fraction obtained from reformed gasoline, the heavy fraction boiling in the range of from 130° C. to the end point of the reformed gasoline; 0-25 vol. % of an alkylate; 1-15 vol. % of LSR; and 3-30 vol. % of MTBE.

The gasoline of this invention may have any optional octane number only if it contains the components (A) and (B) in respective predetermined amounts, and, however, it is desirable that said gasoline have an octane number (research) of at least 95, preferably at least 98 and more preferably at least 100. The term "octane number (research)" used herein means a research octane number as measured by the octane number and octane number test method according to JIS K 2280(ASTM D 2699).

The gasoline of this invention may be optional in distillation characteristics and composition as far as they are within the scope of this invention. To further improve the gasoline in performance such as accelerability, low-temperature starting capability and low-temperature drivability (warming-up property), it is necessary that the gasoline have distillation characteristics satisfying the following conditions (1) and (2) and also have a composition satisfying the following conditions (3), (4) and (5):

$$50 \leqq T_{70} - T_{30} \leqq 85 (°C.) \quad (1)$$

$$0.15 \leqq (T_{90} - T_{70})/(T_{70} - T_{30}) < 0.50 \quad (2)$$

$$0 \leqq V_0(\text{WHOLE}) \leqq 25 \text{ (VOL. \%)} \quad (3)$$

$$V_A(\text{WHOLE}) \leqq 50(\text{vol. \%}) \quad (4)$$

$$V_A(\geqq T_{70}) \geqq 85(\text{vol. \%}) \quad (5)$$

In the above formulae, $T_{30}$, $T_{70}$ and $T_{90}$ indicate 30%, 70% and 90% distillation temperatures, respectively; $V_O$(WHOLE) and $V_A$(WHOLE) indicate the olefin and aromatic contents (Vol. %), respectively; and $V_A$ ($\geqq T_{70}$) indicates the aromatic content (vol. %) in the distillate which was distilled out at temperatures not lower than the 70% distillation temperature.

Formula (1) indicates that the difference between the 70% distillation temperature ($T_{70}$) of the gasoline and the 30% distillation temperature ($T_{30}$) thereof is 50°-85° C., preferably 55°-85° C., more preferably 60°-85° C. and the most preferably 65°-85° C.

Formula (2) indicates a ratio ($T_{90}-T_{70}/T_{70}-T_{30}$) of the difference between the 90% distillation temperature ($T_{90}$) and the 70% distillation temperature ($T_{70}$) to the difference between $T_{70}$ and $T_{30}$ indicated in Formula (1), is 0.15 to less than 0.50, preferably 0.25 to not more than 0.45.

The above 30%, 70% and 90% distillation temperatures mean those as determined by the fuel oil distillation test method according to JIS K 2254(ASTM D 86), respectively.

Formula (3) indicates that the olefin content in the gasoline is 0-25 vol. %, preferably 0-20 vol. %, and Formula (4) indicates that the aromatic content in the gasoline is not more than 50 vol. %, preferably not more than 45 vol. %.

Formula (5) indicates that the aromatic content in a distillate distilled out at temperatures not lower than the 70% distillation temperature ($T_{70}$) is not lower than 85 vol. %, preferably not lower than 90 vol. %. The above olefin content and the aromatic content mean those as measured by the method for testing the hydrocarbon components of a fuel oil (fluorescent indicator adsorption method) according to JIS K 2536(ASTM D 1319), respectively.

Further, the gasoline of this invention may, as required, be incorporated with antioxidants such as phenol- or amine-derived ones, metallic inactivating agents such as Shiff-type compounds or thioamide-type compounds, surface ignition preventers such as organophosphorus-derived compounds, detergent dispersants such as succinic acid imide, polyalkyl amines or polyether amines, anti-freezing agents such as polyhydric alcohols or ethers thereof, alkali metal or alkaline earth metal salts of organic acids, combustion adjuvants such as sulfuric esters of higher alcohols, antistatic agents such as anionic surfactants, cationic surfactants or amphoteric surfactants, and colorants such as azo dyes. The above additives to fuel oils may be added singly or jointly. These additives may be added in any optional amounts, but usually they may preferably be added in a total amount by weight of not more than 0.1%.

Still further, the gasoline of this invention may, as required, be incorporated with octane number improvers such as methanol, ethanol, isopropanol, t.-butanol, ethyl-t.-butyl ether, methyl-t.-amyl ether or ethyl-t.-amyl ether. These octane number improvers may also be added in optional amounts, but usually the above improvers may preferably be added to the gasoline in a total amount by volume of 20% thereof.

This invention will be better understood by the following non-limitative Examples and a Comparative Example.

EXAMPLES 1-3 AND COMPARATIVE EXAMPLE

A specified gasoline of Example 1 and a comparative gasoline of a Comparative Example had their respective properties and compositions as shown in the following Table 1, and specified gasolines of Examples 2 and 3 had their respective compositions as shown in Table 2.

The following tests for estimating the performance of the above specified and comparative gasolines were carried out using these gasolines, with the results being shown in Tables 1 and 2.

The above tests for the estimation of gasoline performances were made by the use of a passenger car having a displacement of 1998 c.c., fuel injection, manual transmission, three way catalyst and $O_2$ sensor, to measure the amount of NOx produced at 10 mode test (Japanese Exhaust Emission Test).

It is apparent from these results that the gasoline of this invention has an excellent NOx-inhibiting effect.

As is apparent from the explanation so far offered, the gasoline containing methyl-t.-butyl ether (MTBE) and light straight-run naphtha (LSR) in the respective amounts according to this invention may maintain a high octane number and reduce the amount of NOx to be contained in exhaust gases when consumed.

TABLE 1

| | Example | Comp. Example |
|---|---|---|
| Base gasoline (vol. %) | 89 | 93 |
| MTBE (vol. %) | 7 | 7 |
| LSR (vol. %) | 4 | 0 |
| Density (15° C.) (g/cm$^3$) | 0.744 | 0.748 |
| Reid vapor pressure (kg f/cm$^2$) | 0.715 | 0.695 |
| Distillation characteristics (°C.) | | |
| IBP (Initial boiling point) | 28.5 | 31.0 |
| 5% | 39.5 | 40.0 |
| 10% | 46.0 | 46.5 |
| 20% | 54.0 | 54.5 |
| 30% | 61.5 | 62.0 |
| 40% | 70.5 | 72.5 |
| 50% | 83.5 | 86.0 |
| 60% | 100.0 | 102.5 |
| 70% | 116.5 | 117.0 |
| 80% | 127.5 | 128.0 |
| 90% | 141.5 | 142.0 |
| 95% | 152.0 | 153.0 |
| 97% | 160.5 | 163.0 |
| EP (End point) | 185.5 | 185.0 |
| Octane number (research) | 100.4 | 100.9 |
| NOx (g/Km) | 0.087 | 0.100 |

TABLE 2

| | Example 2 | Example 3 |
|---|---|---|
| Base gasoline (vol. %) | 93 | 73 |
| MTBE (vol. %) | 5 | 20 |
| LSR (vol. %) | 2 | 7 |
| NOx (g/Km) | 0.085 | 0.089 |

What is claimed is:

1. A specified gasoline comprising as essential components (A) 3-30 vol. % of methyl-t.-butyl ether and (B) 1-15 vol. % of light straight-run naphtha with the balance being a base gasoline, the amount of each of the components (A) and (B) being based on the amount of the specified gasoline and the volume ratio ($V_B/V_A$) of components (A) and (B) has a composition satisfying the following condition:

$$0.34 \leqq V_B/V_A \leqq 1.00$$

wherein $V_A$ and $V_B$ indicate contents (Vol. %) of the components (A) and (B) in the gasoline, respectively.

2. A specified gasoline according to claim 1, wherein the gasoline have distillation characteristics satisfying the following conditions (1) and (2) and have a composition satisfying the following conditions (3), (4) and (5):

$$50 \leqq T_{70} - T_{30} \leqq 85(°C.) \quad (1)$$

$$0.15 \leqq (T_{90} - T_{70})/(T_{70} - T_{30}) < 0.50 \quad (2)$$

$$0 \leqq V_O(\text{WHOLE}) \leqq 25(\text{VOL. \%}) \quad (3)$$

$$V_A(\text{WHOLE}) \leqq 50(\text{vol. \%}) \quad (4)$$

$$V_A(\geqq T_{70}) \geqq 85(\text{vol. \%}) \quad (5)$$

wherein $T_{30}$, $T_{70}$ and $T_{90}$ indicate 30%, 70% and 90% distillation temperatures, respectively; $V_O$(WHOLE) and $V_A$ (WHOLE) indicate the olefin and aromatic contents (Vol. %), respectively; and $V_A$ ($\geqq T_{70}$) indicates the aromatic content (vol. %) in the distillate which was distilled out at temperatures not lower than the 70% distillation temperature.

3. The gasoline according to claim 1 wherein in said light straight-run naphtha the 10% distillation temperature is 30°–40° C. and the 90% distillation temperature is 50°–65° C.

4. The gasoline according to claim 1 wherein the balance of said base gasoline comprises at least one oil which is cracked gasoline obtained by catalytic cracking or hydrocracking; reformed gasoline obtained by catalytic reforming; polymerized gasoline obtained by the polymerization of olefins; alkylates obtained by alkylating a hydrocarbon with a lower olefin; isomerate; dewaxed n-paraffin oil; a fraction of said oils; and aromatic hydrocarbons.

5. The gasoline according to claim 1 wherein the octane number is at least 95.

* * * * *